US006379176B1

(12) United States Patent
Ohsawa et al.

(10) Patent No.: US 6,379,176 B1
(45) Date of Patent: Apr. 30, 2002

(54) FLAT CABLE CONNECTOR FOR ATTACHING A FLAT CABLE TO A CIRCUIT BOARD

(75) Inventors: Fumio Ohsawa; Osamu Miyoshi, both of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/663,772

(22) Filed: Sep. 18, 2000

(30) Foreign Application Priority Data

Oct. 29, 1999 (JP) ..... 11-309926

(51) Int. Cl.[7] ..... H01R 12/24

(52) U.S. Cl. ..... 439/495; 439/74; 439/329; 439/66; 439/862; 439/260

(58) Field of Search ..... 439/495, 299, 439/329, 74, 591, 493, 66, 260, 862, 67, 77, 81, 73

(56) References Cited

U.S. PATENT DOCUMENTS 4,509,811 A * 4/1985 Amano et al. ..... 339/17
5,029,984 A * 7/1991 Adachi et al. ..... 350/334
5,236,366 A * 8/1993 Deak et al. ..... 439/67
5,542,855 A * 8/1996 Asai ..... 439/260
5,562,487 A * 10/1996 Ii et al. ..... 439/495
5,688,143 A * 11/1997 McHugh et al. ..... 439/495
5,707,241 A * 1/1998 Hamlin et al. ..... 439/67
5,716,226 A * 2/1998 Takahashi et al. ..... 439/329
6,062,875 A * 5/2000 Konno et al. ..... 439/74

* cited by examiner

*Primary Examiner*—P. Austin Bradley
*Assistant Examiner*—Truc Nguyen
(74) *Attorney, Agent, or Firm*—Morrison Law Firm

(57) ABSTRACT

A flat cable connector has one or more contact bodies. Each contact body is formed from a bent plate body and has a terminal part and a circuit board contact part. The terminal part of the contact has a u-shape for contacting a flexible circuit board. The circuit board contact part has a flexible curved end for contacting a main circuit board. A housing case is positioned around the contact bodies and has openings on at least one side. The openings are positioned to expose parts of the contact bodies and include an insertion hole and a contact hole. The insertion hole provides access for a connection terminal part of a main circuit board to the circuit board contact parts of the contacts. The contact hole provides access for a flexible circuit board to the terminal parts of the contacts. A moveable cover fits loosely in the insertion hole and anchors the flexible circuit board to the terminal parts of the contacts to form an electrical connection. A device on the main circuit board side of the connector positions and anchors the flat cable connector to the main circuit board to enable the circuit board contact parts of the contacts to make electrical contact with connection terminal parts of the main circuit board. A device on the component side of the housing positions and anchors the flat cable connector to the component.

4 Claims, 5 Drawing Sheets

Fig. 4
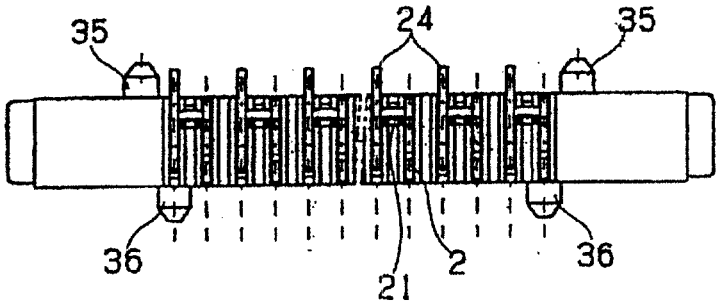
Fig. 5
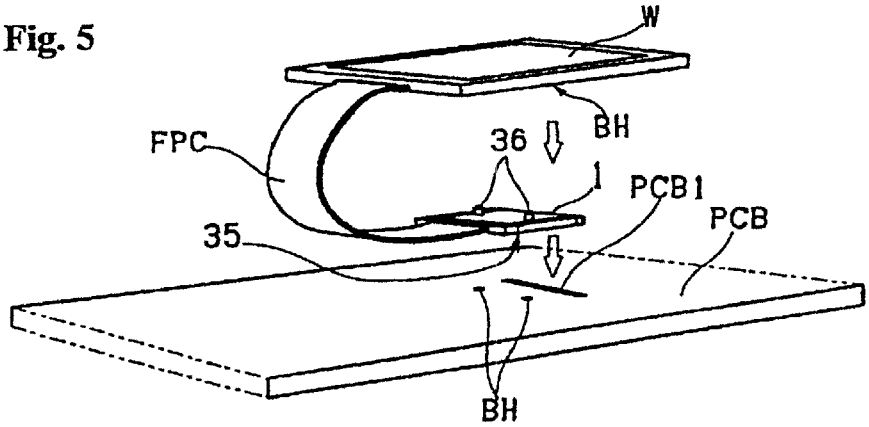
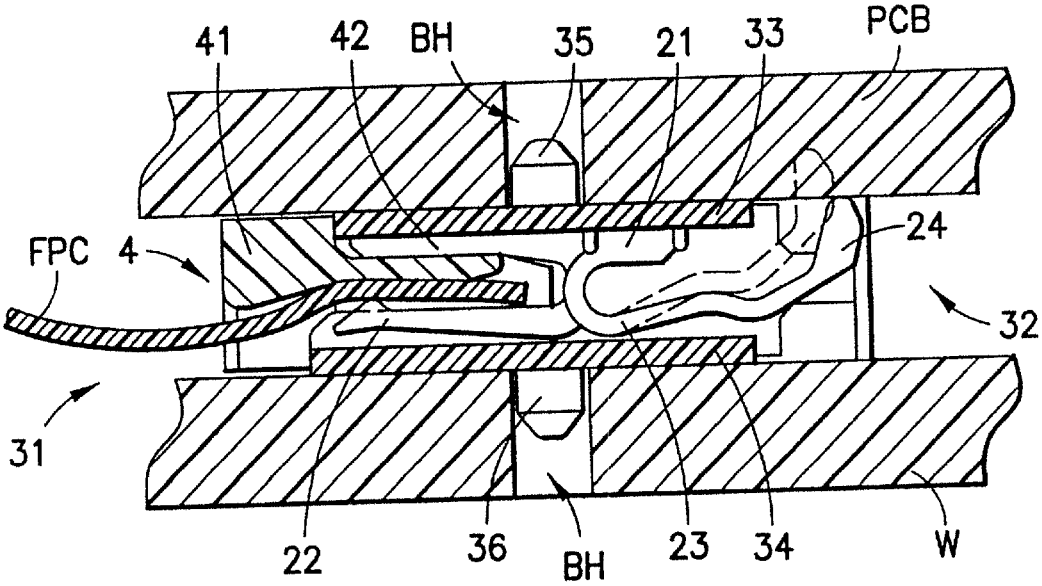
Fig. 6

Fig. 10
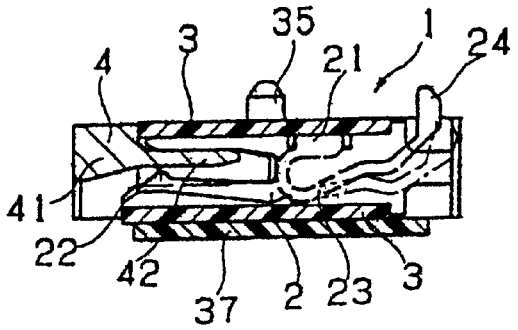
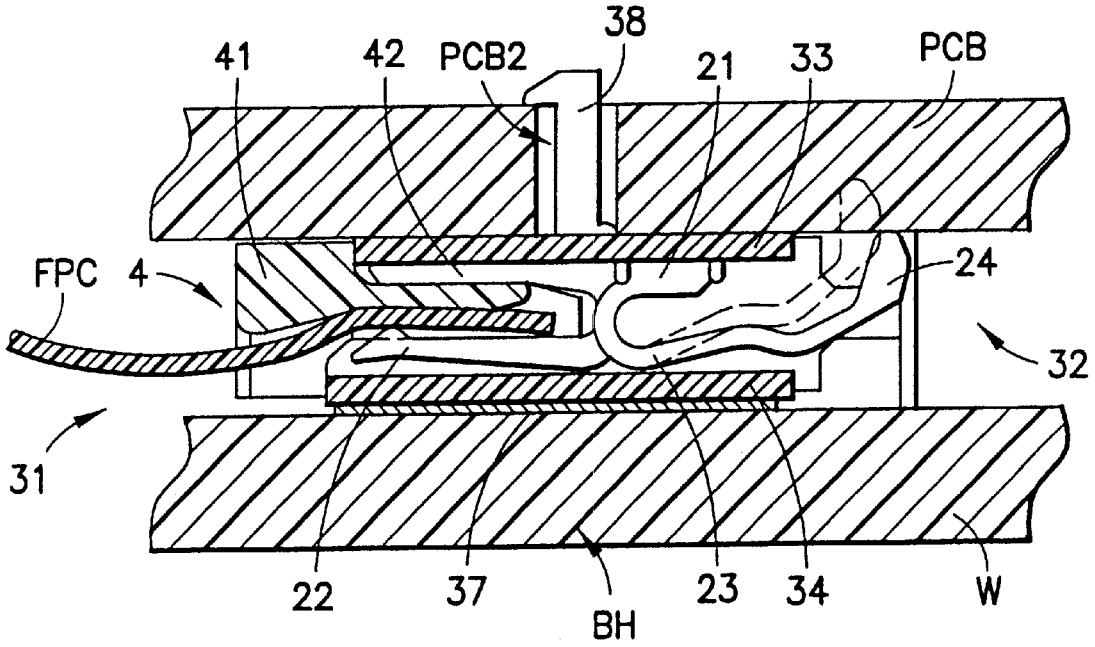
Fig. 11

FLAT CABLE CONNECTOR FOR ATTACHING A FLAT CABLE TO A CIRCUIT BOARD

BACKGROUND OF THE INVENTION

The present invention relates to a connector for attaching a flexible printed board to a printed circuit board. The flexible printed board is connected to electronic components such as a liquid crystal display and the like. More specifically, the present invention provides a connector having positioning and anchoring means which enable attachment of a component and a printed circuit board without having to simultaneously maintain the positions of the electronic component and the main printed circuit board.

A flexible printed board is made of a flexible connection cable and a board having a plurality of connection terminals formed on one end of the board. The flexible printed board is connected to electronic components, such as liquid crystal displays and the like, via a number of connection wires. The flexible printed board connects the electronic component and the main printed circuit board using a variety of connection terminals formed on the end part of the flexible printed board. For example, in cellular telephones, to attach a small liquid crystal display to a main printed circuit board, a flexible printed board comes out of the liquid crystal display and is inserted into a flat cable connector, which has been soldered in advance to a main printed circuit board. Next, the liquid crystal display and the main printed circuit board are connected electrically. Finally, the liquid crystal display is anchored to the main printed circuit board.

Referring to FIG. 12, a prior art example is shown. In the prior art, a flexible printed board 100 is made of a flexible material that can be bent without breaking. One end is anchored by soldering or the like to an electronic component (not shown), such as a small liquid crystal display and the like. A connection terminal part 101 is formed on the other end of the flexible printed board.

A flat cable connector 102 includes: a housing 103, a contact 104 and a cover 105. The housing 103 is a case. The contact 104 is inserted inside the housing 103 in advance. The cover 105 is attached to one side of the housing. An opening 109 is made on one side of the housing 103. The cover 105 is inserted into the opening 109 and is freely detachable therefrom.

On one end of the contact 104 is a terminal 107, which can be soldered to a main printed circuit board 106. A terminal part 108 is located on the other end of contact 104 and contacts connection terminal part 101 of flexible printed board 100 inside housing 103. As a result, main printed circuit board 106 and flexible printed board 100 are connected at contact 104. A plurality of contacts 104 may be arranged in a row and anchored inside the housing 103 such that a terminal part 108 is positioned on an opening 109 side of the housing 103 and the terminal 107 protrudes from the side opposite the opening 109 side. Terminals 107 of contacts 104 arranged in a row and anchored inside flat cable connector 102 in this way, are soldered onto a specified position on the main printed circuit board 106. As a result, a flat cable connector 102 is anchored to the main printed circuit board 106.

Next, the connection terminal part 101 of flexible printed board 100 is inserted from opening 109 of flat cable connector 102, and cover 105 is pushed inside opening 109. The connection terminal part 101 is pressed against terminal part 108 of contact 104 by cover 105. As a result, the connection terminal part 101 of the flexible printed board and the terminal part 108 of the contact 104 are pushed into contact and anchored and connected. Terminal 107 of contact 104 is attached to main printed circuit board 106 by soldering. As a result, flat cable connector 102 and main printed circuit board 106 become connected.

In this configuration, the top of the main printed circuit board 106 is crowded. In addition, many other components are attached at the position where the liquid crystal display (not show) is to be anchored. As a result, the prior art configuration poses problems such as a small working space and difficulty in attaching a flexible printed board 100 to a flat cable connector 102 of a main printed circuit board 106 by pushing in cover 105.

Furthermore, inserting flexible printed board 100 into flat cable connector 102 of main printed circuit board 106 must be conducted without moving the position of the liquid crystal display (not shown). As a result, the liquid crystal display (not shown) and the main printed circuit board 106 must be handled simultaneously. This makes the connection difficult and time consuming.

OBJECT AND SUMMARY OF THE INVENTION

Considering these problems, the object of the present invention is to provide a connector, wherein, connecting electronic components having flexible printed board components such as liquid crystal displays and the like to a main printed circuit board, is made easier. The attachment operation is conducted without spending a large amount of operation time.

Briefly stated, the present invention is a flat cable connector having at least one contact body. Each contact body is formed from a bent plate body and has a terminal part and a circuit board contact part. The terminal part of the contact has a u-shape for contacting a flexible circuit board. The circuit board contact part has a flexible curved end for contacting a main circuit board. A housing case is positioned around the at least one contact body and has openings on at least one side. The openings are positioned to expose part of the contact body and include an insertion hole and a contact hole. The insertion hole provides access for a connection terminal part of a main circuit board to the circuit board contact parts of the contact body. The contact hole provides access for a flexible circuit board to the terminal parts of the contact body. A moveable cover fits loosely in the insertion hole and anchors the flexible circuit board to the terminal parts of the contact body to form an electrical connection. A device on the side of the housing facing the main circuit board positions the flat cable connector with the main circuit board to enable the circuit board contact part of the contact body to make electrical contact with connection terminal parts of the main circuit board. A device on the component side of the housing positions and anchors the flat cable connector to the component.

In an embodiment of the invention, the curved end of the circuit board contact bodies have curved ends which protrude from the insertion hole and are deformed when the main circuit board is pressed against them.

In another embodiment of the invention, a flat cable connector is provided where the devices on the side of the housing used to position the flat cable connector with the main circuit board or the component is a boss designed to fit a corresponding boss hole on the main circuit board or component, respectively.

The action of the present invention is described below.

A flexible printed board is inserted into the flat cable connector through an insertion hole of a housing. When the flexible printed board is inserted a cover is pushed into the insertion hole. The cover being pushed into the insertion hole forces the flexible printed board and the terminal part of the contact to come into contact.

A positioning means provided on the housing and a positioning means provided on a main printed circuit board are joined. Once the main printed circuit board and the housing are in position, a circuit board contacting part of the contact which protrudes from the contact hole of the housing can contact the main printed circuit board at a specified position.

The positioned housing is pushed against the main printed circuit board. The circuit board contact part, which protrudes from the housing, has elastic properties. While being pressed into contact with the main printed circuit board, the circuit board contact part recedes so that it is flush with the housing. After being joined in this manner, the main printed circuit board and the housing are in tight contact. The housing is thus anchored to the main printed circuit board. In this way, the flexible printed board and the main printed circuit board are connected via the flat cable connector.

The positioning means provided on the housing may be formed as a boss protruding from the housing surface. The positioning means provided on the main printed circuit board may be a boss hole formed on the surface of the main printed circuit board. The housing and main printed circuit board are anchored by inserting the boss into the boss hole. With this design, the main printed circuit board and the housing are anchored by joining the boss and the boss hole. w of the first embodiment.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 4 is a back view of the first embodiment.

FIG. 5 is a descriptive drawing showing the attached arrangement for the first embodiment.

FIG. 6 is a cross-section view showing the same attached arrangement for the first embodiment.

FIG. 10 is a cross-section of the third embodiment along line B—B.

FIG. 11 is a central longitudinal cross sectional descriptive drawing of the fourth embodiment.

DESCRIPTION OF THE PREFERRED EMBODIMENTS

Referring to FIGS. 1 to 6, a first embodiment is shown. A flat cable connector 1, comprises: contacts 2, a housing 3 and a cover 4. The contacts are made of bent conductive plates. The housing contains contacts 2 are arranged in a row. The cover 4 is detachable from the housing 3. Referring to FIGS. 5 and 6, flat cable connector 1 serves as a linking connector. A flexible printed board FPC and main printed circuit board PCB are connected by inserting the flat cable connector 1 into a flexible printed board FPC and anchoring the main printed circuit board PCB to the flat cable connector 1.

Referring to FIG. 5, the main printed circuit board PCB is a printed circuit board upon which electrical equipment of IC and the like (not shown) is mounted. In this embodiment, the main printed circuit board PCB is mounted internally in a cellular telephone. A connection terminal part PCB1, having a plurality of exposed contact points, is formed on top of the main printed circuit board PCB. In addition, the main printed circuit board PCB has boss holes BH near the connection terminal part PCB1. A boss hole BH is a positioning means for determining the attachment position of flat cable connector 1. The boss hole BH is also an anchoring means.

A flexible printed circuit board FPC is made of a thin flexible board. A connection terminal part FPC1 (not shown) is formed on one end of the FPC with a plurality of contact points arranged in a row. The other end of the FPC is connected to the component W to be mounted on the main printed circuit board PCB. The component W may be a liquid crystal display or the like. The component W is electrically connected to the main printed circuit board PCB by having connection terminal part FPC1 connect to the flat cable connector 1 which in turn is connected to the main printed circuit board PCB. In this embodiment, component W is a small size liquid crystal display (hereinafter referred to as liquid crystal display W). A boss hole BH is formed underneath the liquid crystal display W surface where flat cable connector 1 attaches to liquid crystal display W.

Figure 7:
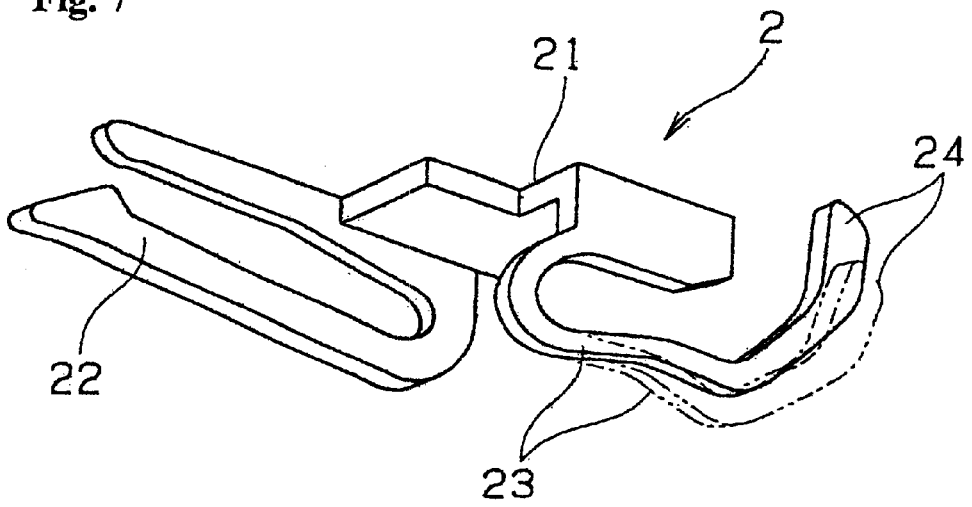
FIG. 7 is a perspective descriptive drawing showing a contact body of the first embodiment.

Referring to FIG. 7, contact 2 is formed by bending a conductive metal plate. The central part of the contact 2 forms a contact body 21, which is anchored to housing 3. A terminal part 22 extends from one end of the contact body 2 while a circuit board contact part 23 extends from another end of the contact body. Terminal part 22 extends at a right angle from the central portion of the contact body 21. Terminal part 22 is curved in a U-shape so that cover 4 and flexible printed board FPC can be inserted into it. The U-shaped groove of terminal part 22 is widened when the flexible printed board FPC is inserted and the cover 4 is pushed in. The flexible printed board FPC is pushed against one end of terminal part 22 by cover 4, and they become electrically connected. The flexible printed board FPC is anchored to flat cable connector 1 by the restorative spring force of terminal part 21 whose U-shaped groove has been widened.

Similarly, a circuit board contact part 23 is on the side of contact body 21 opposite the terminal part 22. This circuit board contact part 23 is bent at a right angle from the contact body 21 and opens in the opposite direction from that of terminal part 22. The end of circuit board contact part 23 has elasticity and is curved in a U-shape. One side of the U-shaped end is a curved end 24 which curves outward. When contacts 2 are arranged in a row in housing 3, the curved end 24 of circuit board contact part 23 protrudes outward from housing 3 surface. Even when the circuit board contact part 23 contacts the printed circuit board and is pressed and deformed, it remain connected to the main printed circuit board PCB with which it is in contact.

Referring to FIGS. 1 through 6, the flat cable connector has a thin-plate case housing 3. One side has a thin rectangular shaped opening which serves as an insertion hole 31. On the opposite side of the housing 3 from the insertion hole 31 is an open contact hole 32. The circuit board contact part 23 of contact 2 protrudes from the contact hole 32. On one surface of the housing 3 is a circuit board contact surface 33. On the surface of the housing 3 opposite the circuit board contact surface 33 is a component anchoring surface 34. The component anchoring surface 34 anchors with liquid crystal display W. A plurality of contacts 2 are provided in a row inside the housing 3. For each of the contacts 2, a curved end 24 of the circuit board contact part 23, protrudes from contact hole 32 towards the circuit board contact surface 33 side of the housing 3. A terminal part 22 of contact 2 is positioned at insertion hole 31. The plurality of contacts 2, that are arranged in a row, are aligned so that the terminal part 22 of each of the contacts 2 can contact each of the contact points of connection terminal part FPC1 on the flexible printed board FPC. In addition, the contacts 2 are aligned so that the circuit board contact part 23 of each contact 2 can contact the connection terminal part PCB1 provided on main printed circuit board PCB. In this configuration, the spacing for each of the contact points of connection terminal parts PCB1 and the spacing for each of the contact points of connection terminal part FPC1 are equal. In other words, the spacing for terminal part 22 of contact 2 and each of the contact points of circuit board contact part 23 are the same as the spacing for each of the contact points of connection terminal part PCB1.

In other configurations, the spacing for each of the contact points of connection terminal part PCB1 and the spacing for each of the contact points of connection terminal part FCP1 can be made different. In this situation, a flat cable connector 1 can be formed by changing the shape of each of contacts 2 which are anchored to housing 3.

Referring to FIGS. 5 and 6 a circuit board side boss 35, which is a positioning means for determining the attachment position to the main printed circuit board PCB, is provided on housing 3. The circuit board side boss 35 protrudes from circuit board contact surface 33 so that it is opposite boss hole BH. Circuit board side boss 35 is shaped to fit boss hole BH. When circuit board side boss 35 is inserted into boss hole BH, the curved end 24 of each of contact 2 contact the connection terminal parts PCB1 of main printed circuit board PCB. The housing 3 is attached to main printed circuit board PCB by inserting circuit board side boss 35 into boss hole BH, so that the curved ends 24 of each of contact 2 are in contact with their respective connection terminal part PCB1. The shape of the circuit board side boss 35 is designed to join with boss hole BH securely and to anchor the housing 3 to main printed circuit board PCB with circuit board contact surface 33 of flat cable connector 1 opposite main printed circuit board PCB. As a result, each contact 2 and connection terminal part PCB1 are electrically connected. In a similar manner, component anchoring surface 34 provided on housing 3 is also fitted with a protruding component side boss 36. Component side boss 36 is placed opposite a boss hole BH of a liquid crystal display W. Flat cable connector 1 is anchored to liquid crystal display W by inserting component side boss 36 into boss hole BH.

Referring again to FIGS. 1 through 6, a cover 4 is provided with a cover base part 41 having an insertion part 42 that is capable of contacting insertion hole 31 of housing 3. The insertion part 42 is narrower than cover base part 41 and is capable of being inserted through insertion hole 31 inside contact 2 anchored inside housing 3. Cover 4 is capable of being inserted inside insertion hole 31 until the protruding insertion part 42 contacts insertion hole 31 of housing 3. Insertion part 42 of cover 4 is loosely inserted inside insertion hole 31 of housing 3 in advance. In this position, connection terminal part FPC1 of flexible printed board FPC can be inserted into insertion hole 31. When terminal part FPC1 of flexible printed board FPC is inserted into insertion hole 31 of housing 3 having a plurality of contacts 2 anchored therein, flexible printed board FPC and terminal part 22 of contact 2 are anchored by the pressure of cover 4 being pushed into insertion hole 31.

With the first embodiment formed in this manner, cover 4 is inserted loosely into insertion hole 31 of housing 3. The connection terminal part FPC1 of flexible printed board FPC is inserted into insertion hole 31 of housing 3. As a result, each of the contact points of connection terminal part FPC1 is positioned at a terminal part 22 of each of contacts 2, inside insertion hole 31. Once in this position, insertion part 42 of cover 4 is pushed into insertion hole 31 until cover base part 41 of cover 4 contacts insertion hole 31 of housing 3. As a result, connection terminal part FPC1 is pressed by cover 4 against terminal part 22 of contact 2 and is anchored in an electrically connected condition. Next, component side boss 36 of housing 3 is inserted into boss hole BH of liquid crystal display W. Thereupon, flat cable connector 1 is anchored to liquid crystal display W by boss hole BH of liquid crystal display W fitted snugly in component side boss 36.

Next, circuit board side boss 35 of housing 3 is inserted into connection terminal part PCB1 of main printed circuit board PCB. Thereupon, the curved end 24 of each of contacts 2, which are anchored inside housing 3, make contact with connection terminal part PCB1 of main printed circuit board PCB. In addition, housing 3 is pushed against main printed circuit board PCB. As a result, curved end 24 of circuit board contact part 23 of contact 2 is deformed. Contact 2 is maintained in position by the spring force of the deformed circuit board contact part 23 whereby it is pushed against and in contact with connection terminal part PCB1 of main printed circuit board PCB. Therefore, housing 3 is anchored to main printed circuit board PCB by having boss 35 and boss hole BH join. In addition, circuit board contact part 23 of contact 2 and connection terminal part PCB1 of main printed circuit board PCB become electrically connected.

In this manner, connection terminal part FPC1 of flexible printed board FPC is inserted into insertion hole 31 of housing 3. Liquid crystal display W is thus attached and anchored to main printed circuit board PCB via flat cable connector 1 by joining circuit board side boss 35 and component side boss 36 with boss holes BH of liquid crystal display W and main printed circuit board PCB, respectively.

Referring to FIGS. 5 and 6, flat cable connector 1 is shown as a linking connector which connects flexible printed board FPC and main printed circuit board PCB by anchoring an inserted flexible printed board FPC, and by further anchoring with main printed circuit board PCB.

Figure 1:
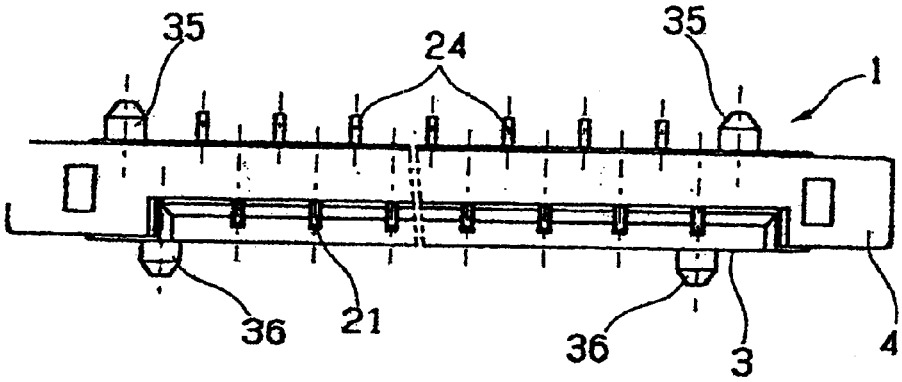
FIG. 1 is a front view of the first embodiment.
Figure 2:
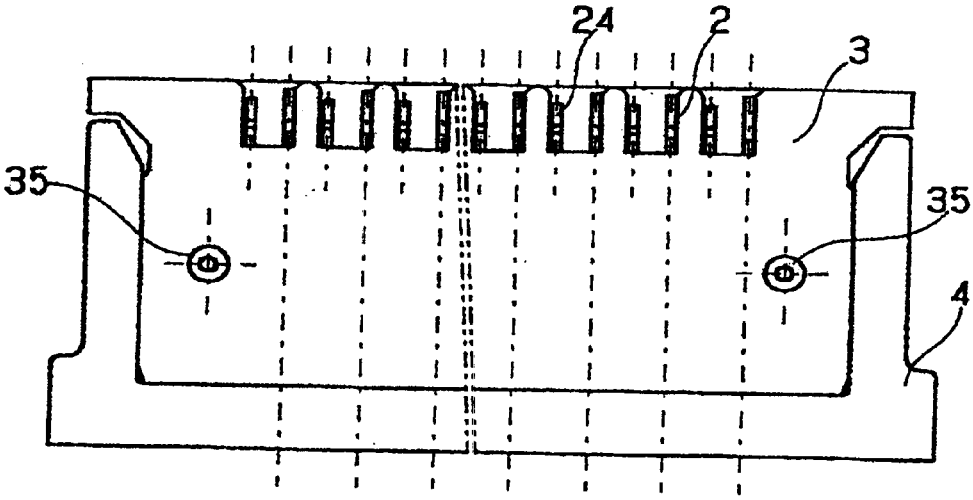
FIG. 2 is a plane view of the first embodiment.
Figure 3:
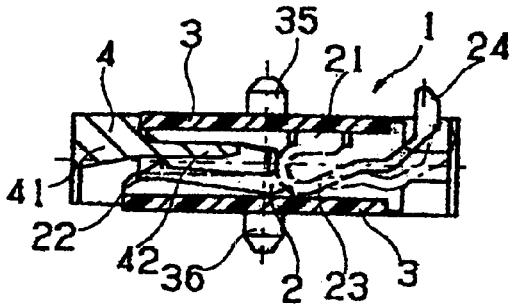
FIG. 3 is a cross-section of FIG. 1 along line A—A.
Figure 8:
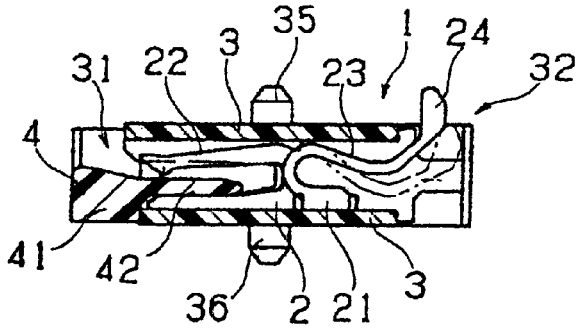
FIG. 8 is a longitudinal central cross-section of the second embodiment.

Referring to FIG. 8, a longitudinal center cross-section of a second embodiment is shown, corresponding to FIG. 3 of the first embodiment. Referring to FIG. 8, in the second embodiment, the position at which connection terminal part FPC1 of flexible printed board FPC is inserted into insertion hole 31 of housing 3 is different from that of the first embodiment. The insertion of flexible printed board FPC via connection terminal part FPC1 into insertion hole 31 is on the circuit board contact surface 33 side of housing 3. In the second embodiment, the mode of action and results are the same as in the first embodiment, except for the different orientation and/or shape of the part where flexible printed board FPC of flat cable connector 1 is inserted.

Figure 9:
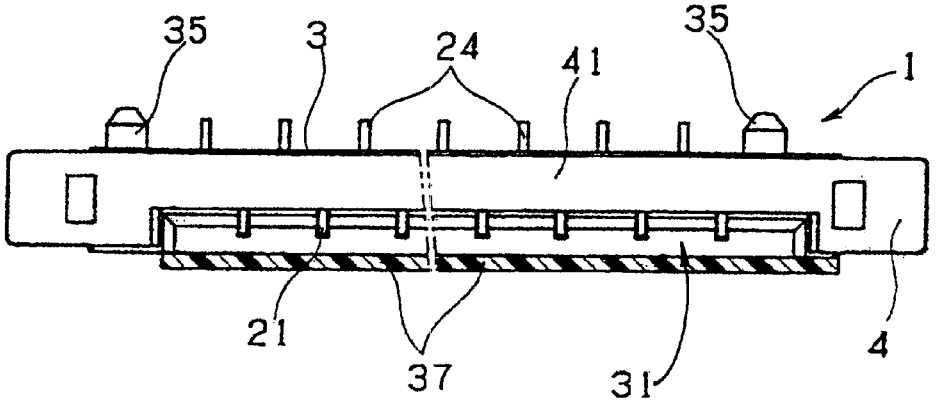
FIG. 9 is a front view of the third embodiment.
Figure 12:
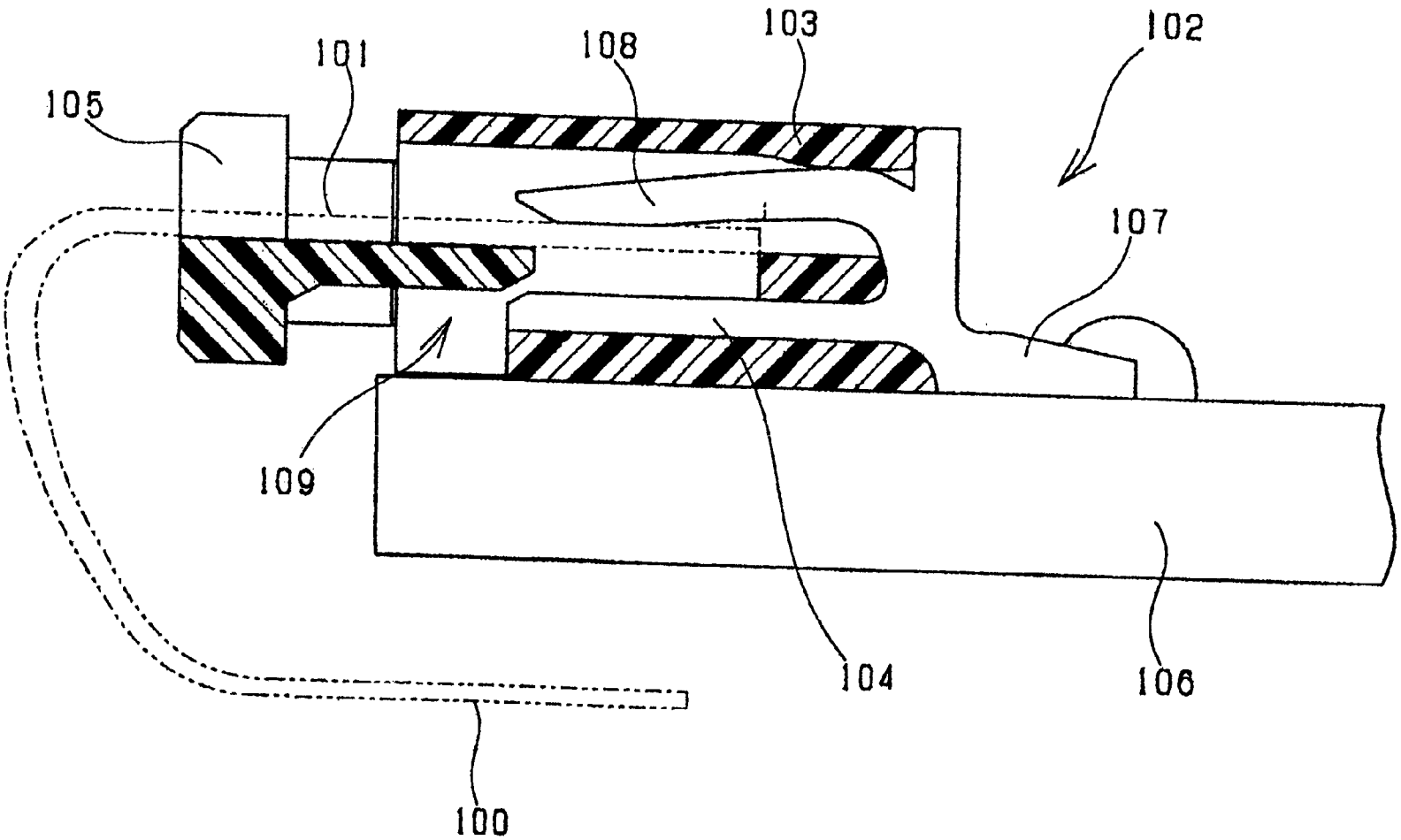
Prior Art Fig. 12
FIG. 12 is a descriptive drawing of the prior art.

Referring to FIGS. 9 and 10, a third embodiment of the invention is show. In the third embodiment, component side boss 36 is not provided as in flat cable connector 1 of the first embodiment. In the third embodiment, instead of component side boss 36, an anchoring means 37 is provided on the component anchoring surface 34 of housing 3. Flat cable connector 1 is attached and anchored at the desired position of liquid crystal display W by anchoring means 37 either before or after terminal part FPC1 of flexible printed board FPC is inserted into insertion hole 31 of housing 3 and anchored by cover 4.

Therefore, in the third embodiment, a component side boss 36 is not provided. As a result, when the attachment position of flat cable connector 1 to liquid crystal display W does not need to be accurate, efficiency of the attachment operation can be improved. In addition, in the third embodiment, even if the object to which flat cable connector 1 is to be attached is not determined, each connection terminal part FPC1 of flexible printed board FPC need only be at the same position as each respective contact 2 of flat cable connector 1. As a result, in the third embodiment, the range of uses of the present invention as a generic product is expanded. In this manner, the position at which flat cable connector 1 is anchored to main printed circuit board PCB is restricted by the positional relationship with curved end 24 of circuit board contact part 23 provided on contact 2 and connection terminal part PCB1 of main printed circuit board PCB. However, with flat cable connector 1 and liquid crystal display W, they are electrically connected by inserting connection terminal part FPC1 of flexible printed board FPC and the position attachment position is not restricted by the electrical connection. As a result, in the third embodiment, flat cable connector 1 need only be anchored within a certain range. In the third embodiment, anchoring means 37 is of a double sided tape which has an adhesive surface on both sides. However, the anchoring means is not limited to this embodiment. Other means can be used, such as adhesives and the like, as long as it serves to anchor the flat cable connector 1.

In the first and second embodiments, each of boss holes BH and circuit board side boss 35 and component side boss 36 are constructed so that by joining the respective boss holes BH with circuit board side boss 35 and component side boss 36, flat cable connector 1, main printed circuit board PCB and liquid crystal display W are anchored. However, although each boss BH and circuit board side boss 35 and component side boss 36 can determine positions, flat cable connector 1 can be constructed so that it is anchored to each by having an adhesive means or the like on circuit board contact surface 33 and component anchoring surface 34 of housing 3, even if anchoring of each of these can not be done by joining.

The first and second embodiments were positioned by boss and boss holes. However, referring to FIG. 11, a fourth embodiment is shown, wherein the flat cable connector 1 and main printed circuit board PCB can be positioned and anchored by an attachment tab 38 which protrudes from flat cable connector 1. In other words, an attachment hole PCB2 can be formed in advance at the flat cable connector 1 attachment position of main printed circuit board PCB. An attachment tab 38, with a protruding part 39, is provided in an upright manner on circuit board contact surface 33 of housing 3. Therefore, at a position similar to boss 35 in the first embodiment where curved end 24 of each contact 2 contacts connection terminal part PCB1 of main printed circuit board PCB, attachment tab 38 protrudes at a position where it can be inserted into attachment hole PCB2. The protruding end of the attachment tab 38 forms a protruding part 39, which is cable of catching with attachment hole PCB2.

Attachment tab 38 is inserted into attachment hole PCB2, and protruding part 39 latches with attachment hole PCB2 at the surface opposite connection terminal part PCB1. Thereupon, with flat cable connector 1, circuit board contact surface 33 of housing 3 is in contact with main printed circuit board PCB surface. Flat cable connector 1 is anchored in a position where each of contacts 2 and connection terminal part PCB1 are connected electrically. This configuration eliminates the problem of loosening of boss 35 and boss hole BH by anchoring attachment hole PCB2 to attachment tab 38.

The positioning means and anchoring means of flat cable connector 1, main printed circuit board PCB and liquid crystal display W shown in each of the embodiments can be appropriately combined and used depending on how and where the flat cable connector is to be used. Furthermore, as long as connection terminal part PCB of main printed circuit board PCB and curved end 24 of flat cable connector 1 are electrically connected, other positioning and anchoring means may be used.

According to the present invention, even if there is little work space from mounted components causing crowding of the main printed circuit board, a flat cable connector can be easily positioned and attached to the main printed circuit board by a positioning means or a boss to improve efficiency of the connector. Furthermore, the flat cable connector is anchored to the main printed circuit board after a flexible printed board is attached to the flat cable connector and after the flat cable connector is first anchored to an attachment component of a liquid crystal display or the like. As a result, flexible printed board and the main printed circuit board do not have to be anchored while simultaneously maintaining the positions of the attachment component of a liquid crystal display or the like and the main printed circuit board. As a result, connections which have been difficult in the prior art, can now be done quickly, easily and more efficiently than in the past.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A flat cable connector, comprising:

at least one contact body;

said at least one contact body being formed from a bent plate body and having a terminal part and a circuit board contact part;

wherein said terminal part has a u-shape effective to contact a flexible circuit board and said circuit board contact part has a curved end effective to contact a main circuit board;

a housing;

said housing serving as a case for said flat cable connector and being positioned around said at least one contact body and having openings on at least one side;

wherein said openings are positioned to expose parts of said at least one contact body and include an insertion hole and a contact hole;

said insertion hole provides access for a connection terminal part of said main circuit board to said circuit board contact part of said at least one contact body;

said contact hole provides access for said flexible circuit board to said terminal part of said at least one contact body;

a cover;

said cover being a movable piece fitting loosely in said insertion hole and capable of anchoring a terminal part of said flexible circuit board to said terminal part of at least one contact body to form an electrical connection;

a positioning and anchoring means on a first surface of said housing;

wherein said positioning and anchoring means is effective to position and anchor said flat cable connector and said main circuit board to enable said circuit board contact part to make electrical contact with a connection terminal part of said main circuit board;

a positioning and anchoring means on a second, opposite surface of said housing;

wherein said positioning and anchoring means is effective to position and anchor said flat cable connector and a component to enable said component to make contact with a component anchoring surface of said flat cable connector; and wherein a curved end of said circuit board contact part protrudes from said contact hole toward said main circuit board, said curved end deforming in a direction opposite said main circuit board when said main circuit board is pressed onto said flat cable connector.

2. A flat cable connector according to claim 1, wherein said positioning and anchoring means is at least one of the group consisting of a boss, an attachment tab and an adhesive tape.

3. A flat cable connector according to claim 1, wherein said insertion hole and said contact hole are on opposite sides of said housing.

4. A flat cable connector according to claim 1, wherein said insertion hole and said contact hole are on the same side of said housing.

* * * * *